US008371051B2

(12) United States Patent
Wu

(10) Patent No.: US 8,371,051 B2
(45) Date of Patent: Feb. 12, 2013

(54) SYSTEM TO LABEL PLATES

(75) Inventor: Min Wu, Carlisle, MA (US)

(73) Assignee: Corning Incorporated, Corning, NY (US)

( * ) Notice: Subject to any disclaimer, the term of this patent is extended or adjusted under 35 U.S.C. 154(b) by 1794 days.

(21) Appl. No.: 10/922,559

(22) Filed: Aug. 19, 2004

(65) Prior Publication Data

US 2005/0072030 A1 Apr. 7, 2005

Related U.S. Application Data

(60) Provisional application No. 60/502,372, filed on Sep. 12, 2003.

(51) Int. Cl.
*G09F 3/00* (2006.01)

(52) U.S. Cl. ..... 40/324

(58) Field of Classification Search ..... None
See application file for complete search history.

(56) References Cited

U.S. PATENT DOCUMENTS 3,627,122 A * 12/1971 Garbe, Jr. ..... 206/571
5,417,457 A * 5/1995 Reinhardt ..... 283/36
2004/0111941 A1* 6/2004 Spear et al. ..... 40/638

* cited by examiner

*Primary Examiner* — Joanne Silbermann
(74) *Attorney, Agent, or Firm* — Hoffmann & Baron, LLP

(57) ABSTRACT

A label for a multi-well plate is provided including a visually observable indicia in a predetermined position on at least an upper side of a portion of the multi-well plate. The indicia has a color in contrast to the multi-well plate and is substantially permanently affixed to at least the upper side of the plate. A method for orienting plates using the label and a system of labeling are also provided.

19 Claims, 9 Drawing Sheets

SYSTEM TO LABEL PLATES

RELATED APPLICATIONS

This application claims the benefit of U.S. Provisional Application No. 60/502,372 filed on Sep. 12, 2003 which is hereby incorporated by reference in its entirety.

BACKGROUND OF THE INVENTION

1. Field of the Invention

The present invention relates to system of using labels for multi-well plates useful in a variety of applications. More particularly, the invention relates to use of one or more labels to unambiguously identify the location of samples in a multi-well plate for proper orientation of the samples when loading samples into a plate and loading the plate into a device such as a processing center or plate reader.

2. Description of Relevant Art

Multi-well plates are typically used in high-throughput applications as well as in numerous research and development applications. Multi-well plates typically comprise an array of depressions formed in a generally planar surface of a tray and may be provided with a lid. Typical multi-well plates contain 96, 192, 384, or 1536 rectangular receptacles which must be filled with a predetermined amount of a liquid or other sample and later manipulated.

Certain multi-well plates are specifically adapted for growing cells in media. These multi-well plates have a multi-well plate which may be placed into a tray containing growth media. An example of this type of multi-well plate is an insert plate. In insert plates, the wells include a porous membrane toward the lower end of the well. The plate is placed in the tray. The membrane can contact the media in the tray and is permeable to various compounds such as nutrients and the like. Examples of insert plates include BD Falcon™ HTS FluoroBlok™ Insert Systems and BD Falcon™ HTS Insert Systemsavailable from Becton Dickinson and Company, Franklin Lakes, N.J.

Strip plates are one form of multi-well plates suitable for use in ELISA assays and PCR reactions. Strip plates are multi-well plates having a plurality of individual rows of wells arranged in a support member. The individual rows of wells are referred to as strips. A typical strip plate will include eight (8) or twelve (12) wells per strip. The support members are configured to fit into a frame. The frame is configured to hold eight (8) or twelve (12) such strips. It is possible to use one or more of the strips in the frame for any given procedure.

The use of multi-well plates depends upon the particular application. Multi-well plates are often used in high-throughput assays and other biological applications by testing batches of compounds also referred to as libraries or combinatorial libraries, for binding activity or biological activity against target molecules such as cells, an antibody, receptor, enzyme, transcription factor or the like.

To facilitate high-throughput screening techniques, a number of automated platforms have been developed. One system, for example, includes an automated multi-purpose analytical chemistry processing device and laboratory work station having a movable table for supporting multi-well plates and other fluid receptacles, a movable arm, and a modular mobile pod affixed for reciprocal movement along the arm.

The workstation combines into a single programmable system the capabilities for automation of a wide range of bioanalytical procedures including, not only sample pipetting, serial dilution, reagent additions, mixing, reaction timing and similar known manual procedures, but also programmable spectrophotometric measurements and other physical parameters, further processing based on these measurements and automatic data recording. Multi-well plates must be designed to conform to the specifications of such automated processing centers used in modern high-throughput assays.

Additionally, prior to the use of high-throughput assays, conditions must be optimized in order to make such assays reliably usable in such a platform. Multi-well plates are often therefore used in assay development applications. In these applications, as opposed to high-throughput applications, it is often necessary to manually fill the wells of the multi-well plates and then to manually load the filled plates into a device such as a plate reader.

Furthermore, academic research is often performed in a laboratory setting that is not equipped to perform high throughput assays. Rather, the research is performed as described above, with manual filling of multi-well plates and manual placement of the plates into plate readers or the like.

It is important while adding samples into the plates and loading them into a processing center or other device to be aware of the identity of the sample in each well. Multi-well plates are usually labeled in some fashion in order to allow a user to specifically identify each sample in each well. For example, plates having alphanumeric identifiers of well locations are known. These plates have an indication of horizontal sequential numbers along a perimeter of one side of the plate and an indication of vertical sequential letters along a perimeter of an adjacent side of the plate. Usually these indicators consist of raised alphanumeric indicators of the same color as the plate. It is possible to use these alphanumeric labels to properly orient the plates into devices such as plate readers and the like.

Additionally, some multi-well plates are also configured with a geometry at the base of the plate or tray so as to require they be placed in a particular orientation when being loaded into certain devices. In these configurations, there is no corresponding geometry in a plate accepting portion of the device to that of the base of the plate or tray. Consequently, the multi-well plates may be placed in the device in either orientation.

The Society for Biomolecular Screening (SBS) has set standards for microplates including standard SBS-1 Footprint Dimensions and standard SBS-4 Well Positions. Presently, there is no universally accepted standard for design of plates and devices such as processing centers and/or readers so that the plates can be loaded into the devices in only one orientation. For devices and multi-well plates which are not configured so that the plate may be placed in the device in only one orientation, it is possible to mis-load the plates into the device. Specifically, it is possible, such as, for example, when using a Victor 2 Multilabel Counter (Perkin Elmer Wallac Inc., Gaitherburg, Md.) or a Discovery-1™ High Content Screening System (Molecular Devices, Sunnyville, Calif.) to load the plates in more than one orientation.

Improper orientation of the plates in the device can result in either a loss of data or collection of data that is incorrect. A user loading the plates into the reader quickly may not notice whether the alphanumeric labels are in the proper orientation. This is especially true when the alphanumeric indicators are the same color as the plate. Furthermore, when multi-well plates are stacked, it is not possible to see the conventional multi-well alphanumeric markings on any but the topmost plate. A user who believes they have stacked a plurality of plates in a single orientation may later load a device with the plates using a technique in which the plates are each placed in the device in the same orientation in which they have been stacked. Inadvertent mis-stacking of the plates may not be detected at the time the plates are loaded into the device.

It is therefore desirable to have an unambiguous label and system of labeling to avoid the possibility of misloading plates into devices such as processing centers and/or readers.

Furthermore, it would be advantageous to have a label and labeling system in which the orientation of samples in a plurality of plates can be viewed when the plates are in a stacked configuration.

SUMMARY OF THE INVENTION

Figure 1:
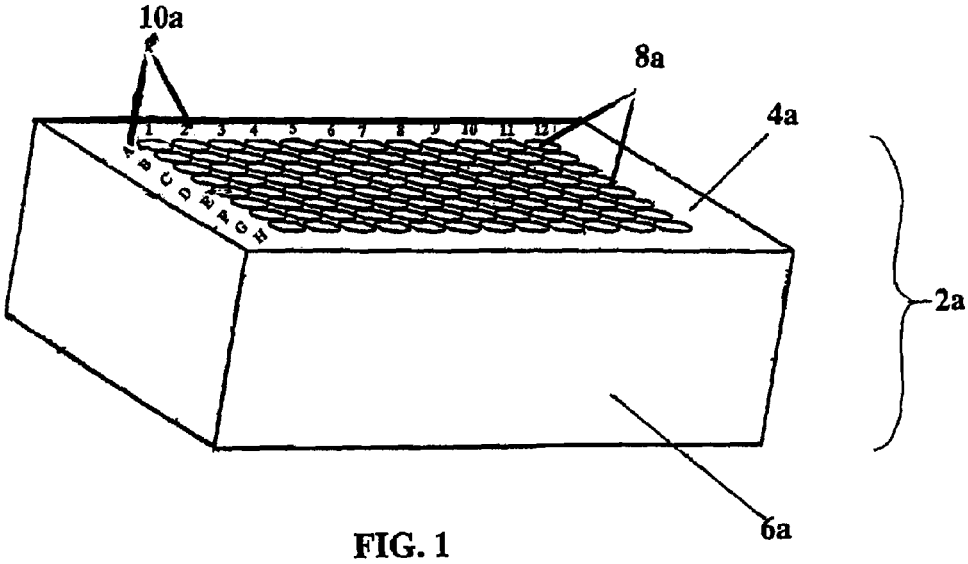
FIG. 1 PRIOR ART
FIG. 1 is a perspective view of a conventional multi-well plate having alphanumeric indicators for each well.

The present invention provides a label and labeling system to clearly and unambiguously label multi-well plates so as to verify correct orientation of plates and to assure the samples are properly added in pre-specified orientation and the plates are properly loaded into devices such as processing centers, readers, and the like.

The present invention relates generally to a label for a multi-well plate including a visually observable indicia in a predetermined position on at least an upper side of a portion of the multi-well plate. The indicia has a color in contrast to the multi-well plate and is substantially permanently affixed to at least the upper side of the plate.

Optionally, the invention includes a further indicia on a side wall of a plate portion of a multi-well plate. Desirably, the indicia are striking visual indicators such as a brightly colored symbol.

Additionally, a method of orienting at least one multi-well plate in a predetermined orientation is provided including labeling the plate with a label of the invention, visually observing the indicia of the label to detect a present orientation and comparing the present orientation to the predetermined orientation. If necessary, the plate or plates are placed in the predetermined orientation using the label as a guide for placement.

Also provided is a labeling system for orienting one or more multi-well plates in a known orientation including labeling. The system includes selecting a predetermined position for placement of a label of the invention as a convention and consistently using said convention to visibly confirm proper placement of said samples into the plates and placement of said plates in a device or laboratory setting.

The present invention applies not only to certain fields within the chemical industry such as biotechnology, biochemistry and the like, but is also suitable for carrying out research in biological chemistry, inclusive of microbiology, or various kinds of chemical reaction tests such as a clinical diagnosis.

It is an advantage of the present invention, that a reliable and inexpensive label and labeling system for multi-well plates is provided which unambiguously establishes orientation of one or more multi-well plates for correct placement of samples in a plate and the correct placement of plate or plates in a device.

With the foregoing and additional features in mind, this invention will now be described in more detail, and other benefits and advantages thereof will be apparent from the following detailed description when taken in conjunction with the accompanying drawings, in which like elements are identically numbered throughout the several views.

DETAILED DESCRIPTION OF THE PREFERRED EMBODIMENTS

The present invention provides a label and labeling system for unambiguously establishing orientation of each well of a multi-well plate and optionally the orientation of a plurality of multi-well plates with respect to one another. The label and labeling system provide, inter alia, for correctly addition of samples into a plate and loading multi-well plates into a device such as a plate reader.

The label and labeling system are particularly useful in assay development applications where a user will fill, stack, carry and then load multi-well plates into a device. Use of the label and labeling system prevents mistakes in adding of samples into a plate and loading the plates into a device by providing a readily identifiable indicia of whether or not the plates are loaded correctly.

The present invention is directed to a label and system of using the labels. The label comprises a readily identifiable indicia at a designated or predetermined position on at least an upper side of a portion of a multi-well plate. Preferably, the label is a vivid single or multi-color indicia which contrasts to the color of the material from which the multi-well plate is formed. The label is preferably substantially permanent and will not readily rub off upon friction contact or wash off upon exposure to water or other solvents.

Referring now to FIG. 1, a conventional multi-well plate is shown. The plate, generally referred to by reference numeral 2*a*, includes an upper side 4*a* and a perimetric side wall 6*a*. The upper side 4*a* includes a plurality of openings or wells 8*a*. The wells 8*a* may be filled with a test sample, a reagent, cells dosed with a drug candidate, or the like. The upper side 4*a* is labeled with alphanumeric indicators 10*a*. The alphanumeric indicators 10*a* give a unique alphanumeric identity to each of the wells 8*a*.

Figure 2:
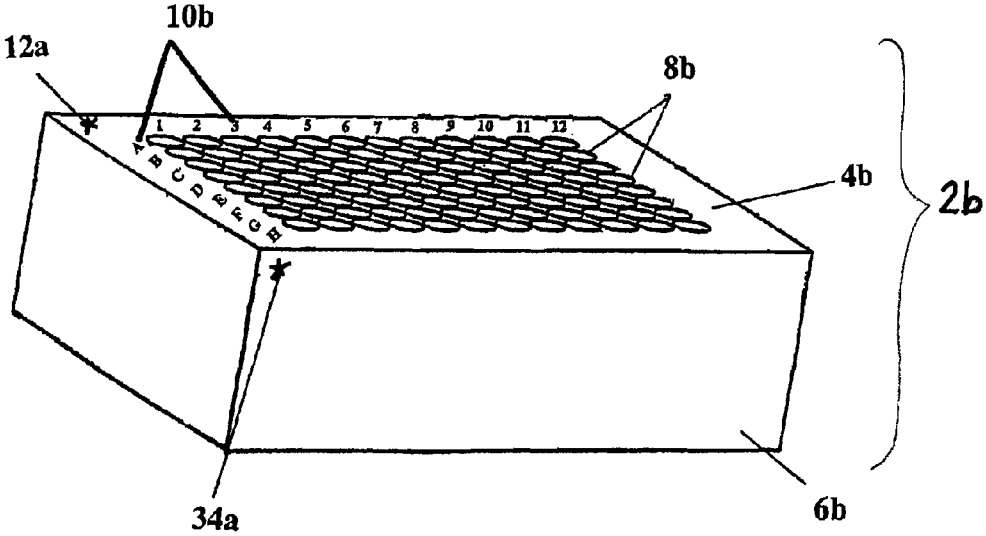
FIG. 2 is a perspective view of the plate of FIG. 1 labeled in accord with the invention.

Referring now to FIG. 2, a multi-well plate 2*b* of FIG. 1 is shown including an upper label or indicia 12*a* according to the invention. Although an 8 ×12 array (96 well) plate is shown, other configurations are also available and include plates having 2×3 arrays (6 wells), 2×4 arrays (8 wells), 4×6 arrays (24 wells), and 16×24 arrays (384 wells). The label and labeling system of the invention may be used with any multi-well plate.

In FIG. 2, the upper label 12*a* is placed in the upper left hand side of the upper side 4*b* of the plate 2*b*. There are no particular limitations to the location selected for the placement of the upper label 12*a* provided that the label is consistently placed in the same location for each plate and the label 12*a* is not centered on the plate 2*b*. If the label 12*a* were to be placed centrally in the upper side 4*b*, then a user could be confused as to the proper orientation of the plate 2*b*. Furthermore, depending on the use of the multi-well plate, the label 12*a* should be placed in a location where it will not interfere with the function of the device in which it is placed. For example, a label 12*a* that is too close to the wells 8*b* may interfere with spectrographic readings when using, for example, a plate reader. Desirably, the label 12*a* is placed toward a perimeter of the upper side 4*b* of the plate 2*b* rather than an interior thereof.

The upper left hand side is selected as a convenient convention for the location of the label 12*a*, as most people read from left to right and from top to bottom. Therefore, it is more likely a user will notice the label 12*a* in this location as opposed to a different location. However, other locations are possible.

Figure 3:
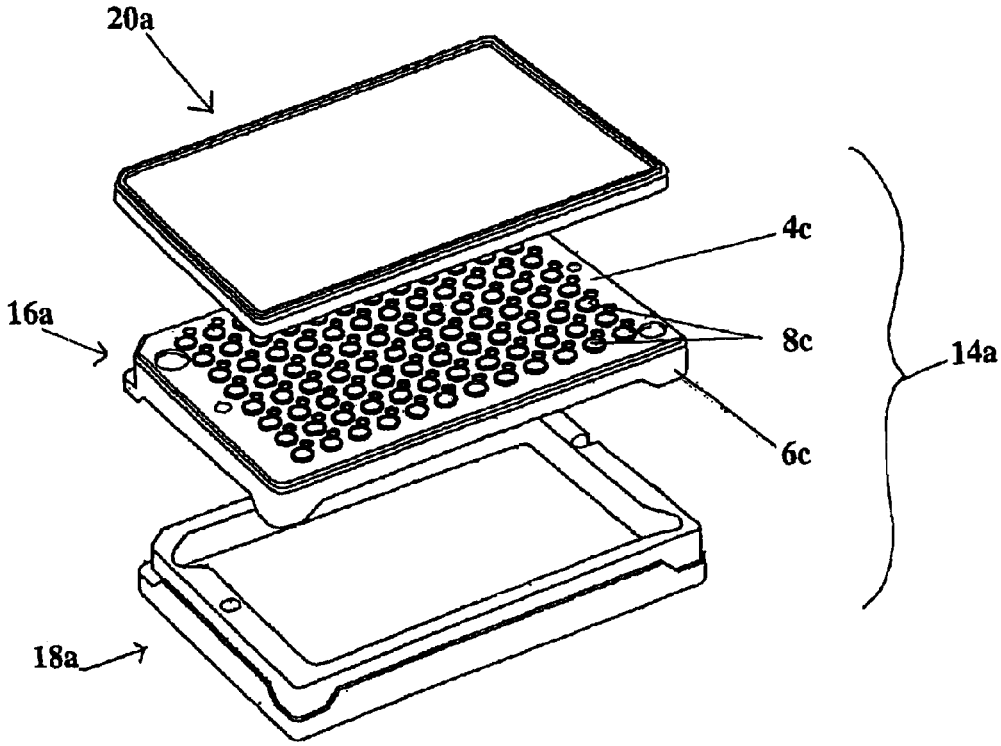
FIG. 3 PRIOR ART
FIG. 3 is perspective view of a conventional insert plate.

Referring now to FIG. 3, a conventional insert plate is shown. The insert plate, generally referred to by reference numeral 14*a*, includes a multi-well filter plate 16*a* having an upper side 4*c* and a perimetric side wall 6*c*. The upper side 4*c* includes a plurality of wells 8*c*. A porous membrane (not shown) is secured to the bottom of each of the wells 8*c*. The insert plate 14*a* also includes a feeding tray 18*a* for supplying media to cells grown in the wells 8*c*. A removable lid 20*a* covers the filter plate 16*a* to maintain sterility within the wells and to minimize evaporation of the nutrient media.

Figure 4:
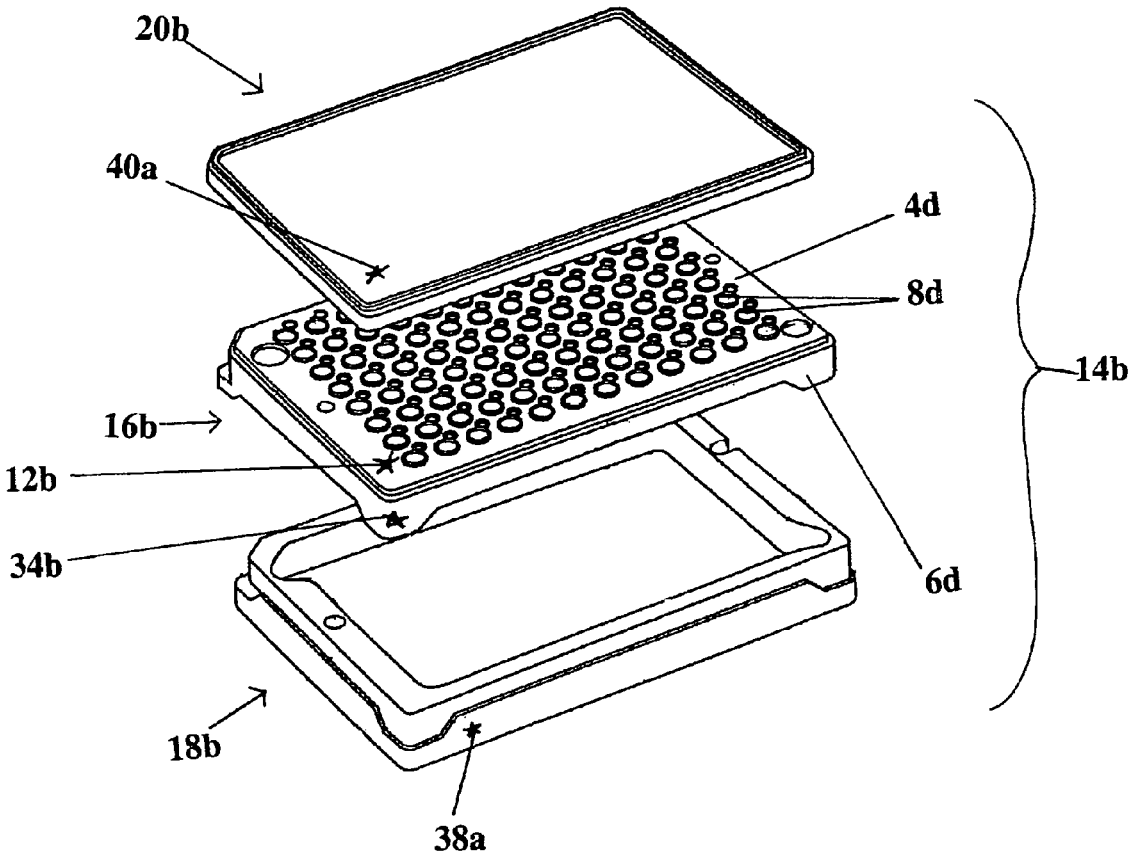
FIG. 4 is a perspective view of the insert plate of FIG. 3 labeled in accord with the invention.

Referring now to FIG. 4, an insert plate 14*b* is shown including a label according to the invention. The insert plate 14*b* includes a filter plate 16*b* having an upper side 4*d* and a perimetric side wall 6*d*. The upper side 4*d* includes a plurality of wells 8*d*. In this embodiment, the filter plate 16*b* includes an upper label 12*b* according to the invention arranged toward a lower right hand corner of the insert plate 14*b*.

The present invention optionally includes additional labels to further assure proper orientation of a multi-well plate in a device. As shown in FIG. 2, as side label 34*a* is placed on the side wall 6*b* of a multi-well plate 2*b*. As shown in FIG. 4, a side label 34*b* may be placed on the side wall 6*d* of the filter plate 16*b*. Optional additional labels may be placed elsewhere on the multi-well plate for additional confirmation of correct orientation of the multi-well plates in a device. Referring again to FIG. 4, the tray 18*b* and the lid 20*b* may also be labeled, 38*a* and 40*a*, respectively. In a preferred embodiment, each of the labels are arranged in the vicinity of one another to provide a visual confirmation of proper orientation.

Figure 5:
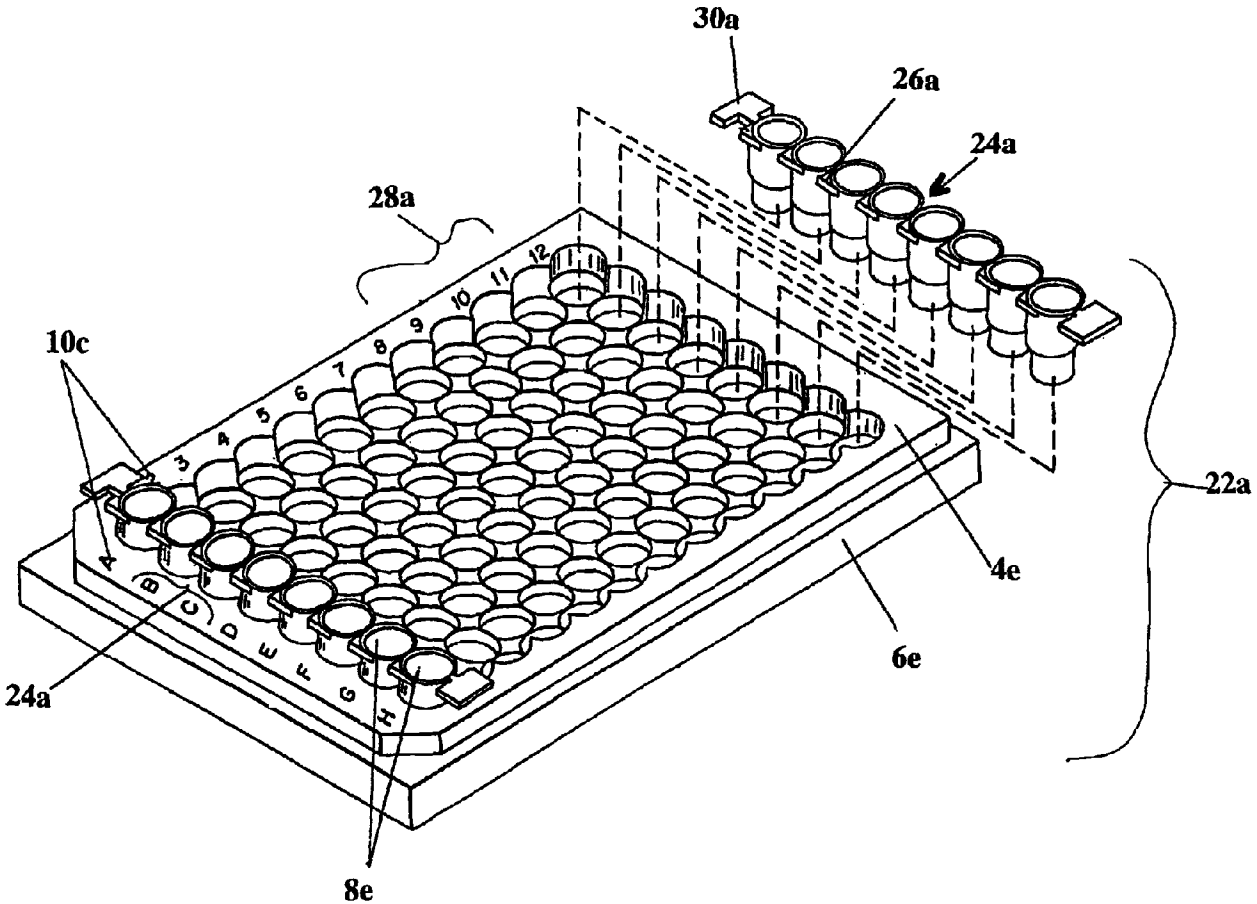
FIG. 5 PRIOR ART
FIG. 5 is a perspective view of a conventional strip plate.

Referring now to FIG. 5, a conventional strip plate is shown. The strip plate, generally referred to by reference numeral 22*a*, includes a plurality of multi-well strips 24*a* with each strip 24*a* having a row of wells 8*e* arranged in a support 26*a*. The strip plate 22*a* also includes a frame 28*a* for holding the strips 24*a* in place. The frame 28*a* may accommodate one or more strips 24*a*. The frame 28*a* includes an upper side 4*e* and a side wall 6*e*. Alphanumeric identifiers 10*c* appear on the upper side 4*e* of the frame 28*a* to specifically identify each well of a strip 24*a* placed therein. Each strip 24*a*, alone or individually, may be readily insertable and removable from the frame 28*a*. In FIG. 5, two strips 24*a* are shown with one strip being placed in the frame 28*a* and one strip being shown outside of the frame. As may be appreciated, it is possible to place strips 24*a* of a strip plate out of order or upside down. A tab 30*a* is provided on the support 26*a* for aid in marking the proper location of the strip 24*a* in the frame 28*a*. Without a particular convention for labeling the tabs 30*a*, it is possible to confuse the strips 24*a* with one another. Furthermore, markings made on the tab 30*a* may become wet and washed off during handling.

Figure 6:
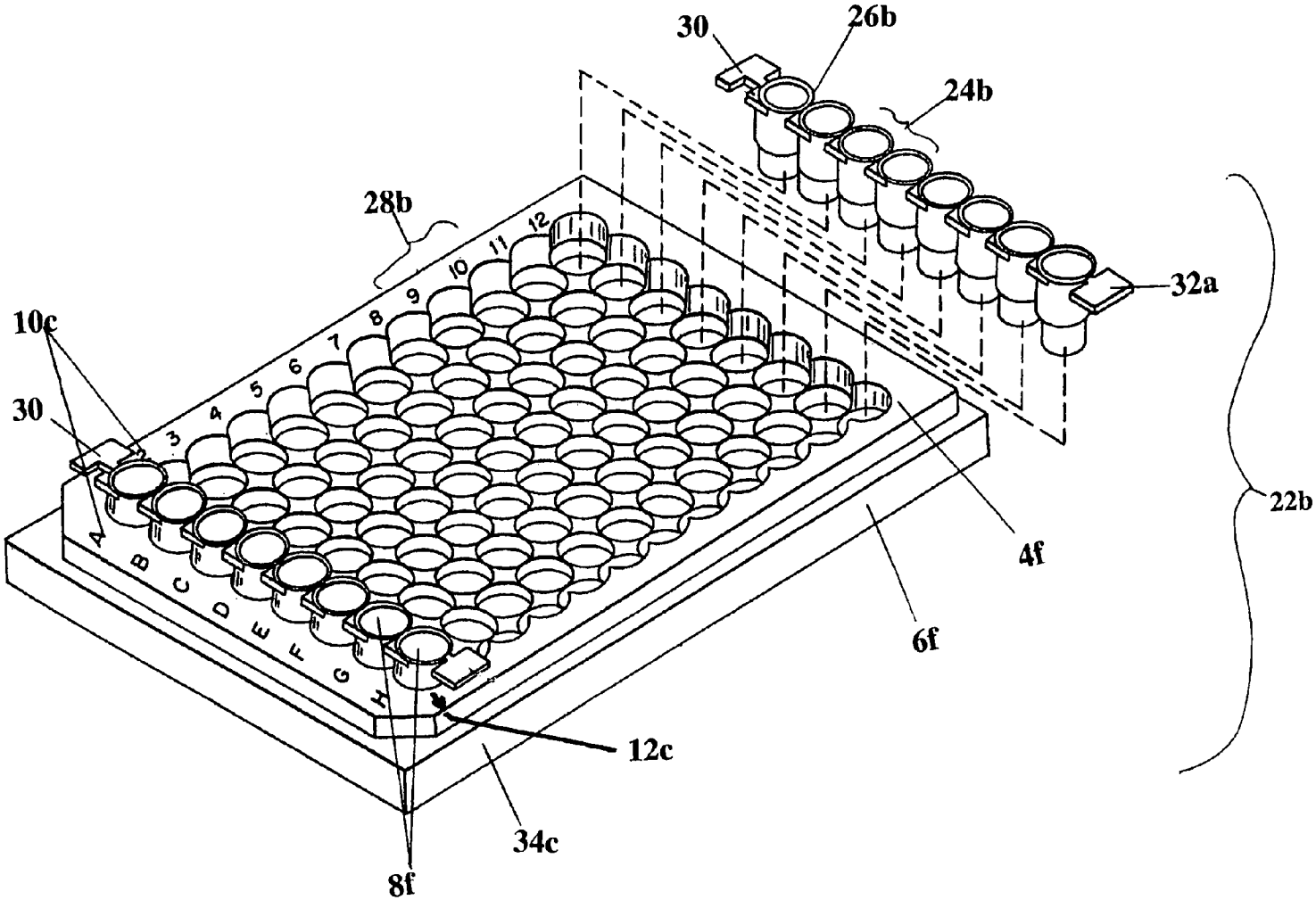
FIG. 6 is a perspective view of the strip plate of FIG. 5 labeled in accord with the invention.

Referring now to FIG. 6, a strip plate 22*b* is shown labeled in accord with the invention. In this embodiment, the strip plate 22*b* includes an upper label 12*c* on a lower right hand portion of the upper side 4*f* of the frame 28*b* in the form of a downward pointing arrow. The side wall 6*f* of the frame 28*b* includes a side label 34*c* for further identification of the orientation of the multi-well plates.

A multi-well strip 24*b* is shown having an additional label 32*a* on a tab 30*b* of the strip 24*b*. The label appears in the form of a number and a downward pointing arrow. The number part of the label is selected to match the number assigned to the row. In strip plate 24*b* applications, it is preferred to provide an additional label 32*a* on each of the strips 24*a* including either an alphabetical or numerical indicia as part of the additional label 32*a*, with the alphabetical or numerical indicia conforming to the alphabetical or numerical indicia, respectively, present on the frame 28*b*. Thus, the proper order of strips 24*b* will be verified as well as the orientation of the strips 16*b* with respect to the frame 28*b*.

As in previous examples, there are no particular limitations on the placement either the side label, upper label and additional label independently, or of the side label, upper label and additional label in relation to one another. The relative orientation as shown in FIG. 6 is advantageous because it allows a user to receive visual confirmation of correct placement of the strips to confirm proper sequential arrangement along both axes.

In laboratory settings, multi-well plates are often manually filled with a sample and/or reagent at a laboratory work station prior to analysis. The plates must then be transported from the laboratory work station to the location where they will be analyzed, for example to a plate reader. Many conventional multi-well plates are stackable for this purpose. It is often the case that when a plurality of plates are to be tested, they are transported in stacks to the location where the measurement or other device resides. However, as has been described previously, conventional multi-well plates lack identifiers other than the alphanumeric identifiers located on the upper side of the multi-well plate. These identifiers are not visible once the plates are stacked. This shortcoming can result in mis-loading of samples into a plate and mis-loading of the plates into a device, and mismatched data collection.

If a stack of plates are not each oriented in the same direction, but are each loaded into the device using the same loading technique for each plate, then some of the plates will be mis-loaded. This can occur especially if one user fills the plates and a second user loads them into the device. The second user may assume the plates are properly oriented and merely load each plate into the machine in a perfunctory fashion. If the mistake is discovered, it may be possible to transpose data received from the device, so as to match the result with the proper sample. If the mistake is not discovered, then the results may lead to misinterpretation of data, delay in analysis or expensive repetition of the analysis. If the mistake occurs in a diagnostic setting, catastrophic results such as misdiagnoses may occur. Therefore, it is also important to be able to identify the proper orientation of plates when they are in a stacked configuration.

Figure 7:
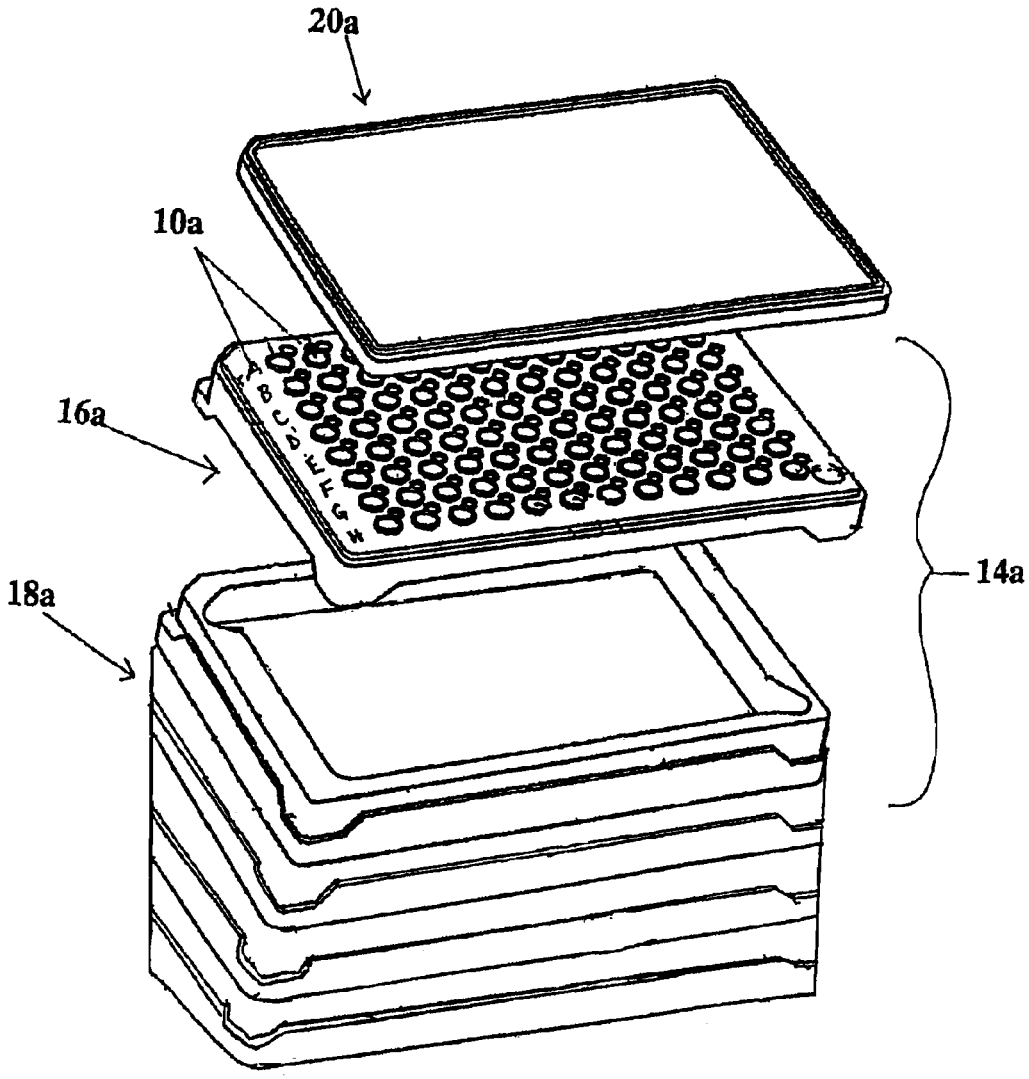
FIG. 7 PRIOR ART
FIG. 7 is a perspective view of stacked conventional multi-well plates.

Referring now to FIG. 7, a stack of conventional insert plates is shown. When transporting the plates 14*a*, the conventional alphanumeric identifiers 10*b* will be obscured by the lid 20*a*. Absent additional plate configurations or identifiers, it is possible to stack the plates 14*a* in varying orientations. There is no clear indicia of the relative orientation of the plates with respect to one another.

Figure 8:
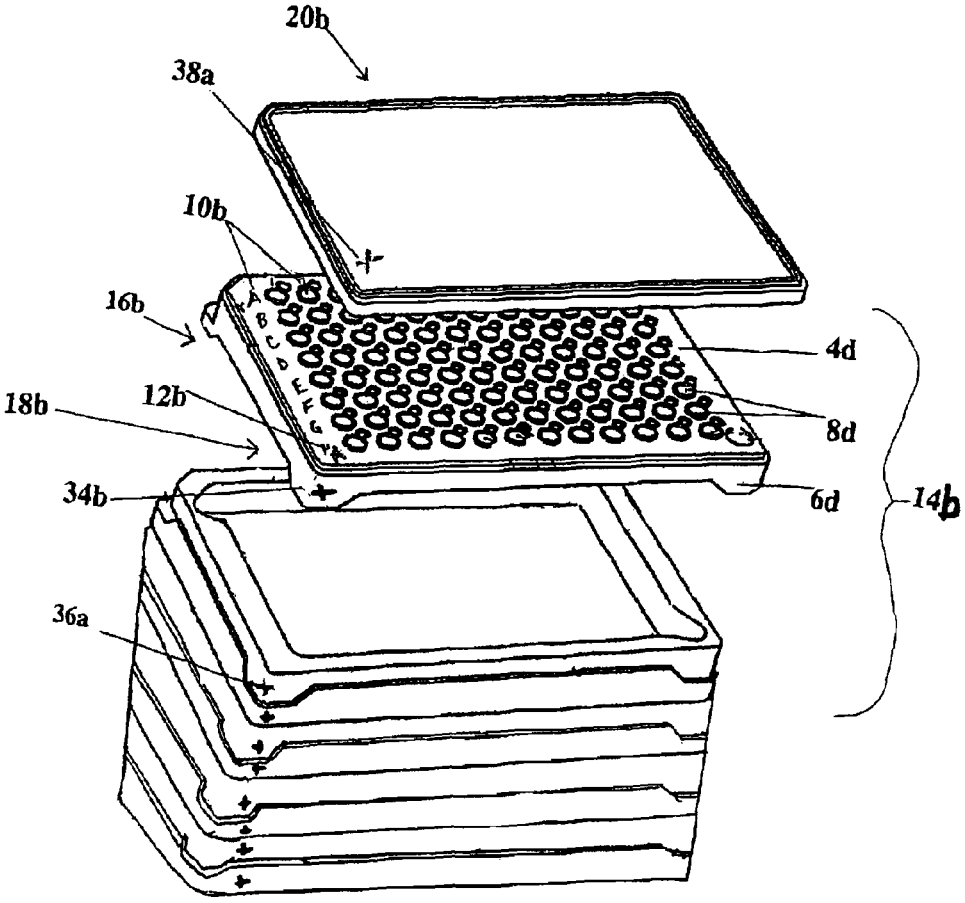
FIG. 8 is a top perspective view of the stacked multi-well plates as shown in FIG. 7 including labels in accord with the invention.

In contrast, plates labeled according to the invention give a clear indicia of the proper orientation of the plates, even when in a stacked configuration. This advantage is shown in FIG. 8, as exemplified by insert plates. In FIG. 8, each of the stacked insert plates 14*b* includes a side label 34*b* provided on a side wall 6*b* of the plate 14*b*. Visual confirmation of proper alignment of the plates 14*b* in a common orientation is possible observing at least the side label 34*b*. The side label 34*b* may be placed in any location on the side wall 6*d* as long as the placement is consistent. Advantageously, as a convention, the side wall 6*d* will be labeled such that a user will visually see the side label 34*b* when plates are held in the usual position for loading a device therewith. Thus, it will be readily apparent by glancing at the side of the plates 14*b* whether or not they are in alignment and properly oriented.

For insert plates, it is also advantageous to label the tray 18*b*. A tray label 36*a* is shown in FIG. 4 and FIG. 8. The tray label 36*a* will assist in confirming proper orientation of the multi-well plates, especially when stored in a stacked configuration. Similarly, a lid label 38*a* may also be used.

Because the labels and labeling system of the present invention may be used with multi-well plates sized to conform to the Society for Biomolecular Screening (SBS) standards, it is possible to use the present invention in conjunction with existing robotic based methods used to automate handling of samples.

Figure 9:
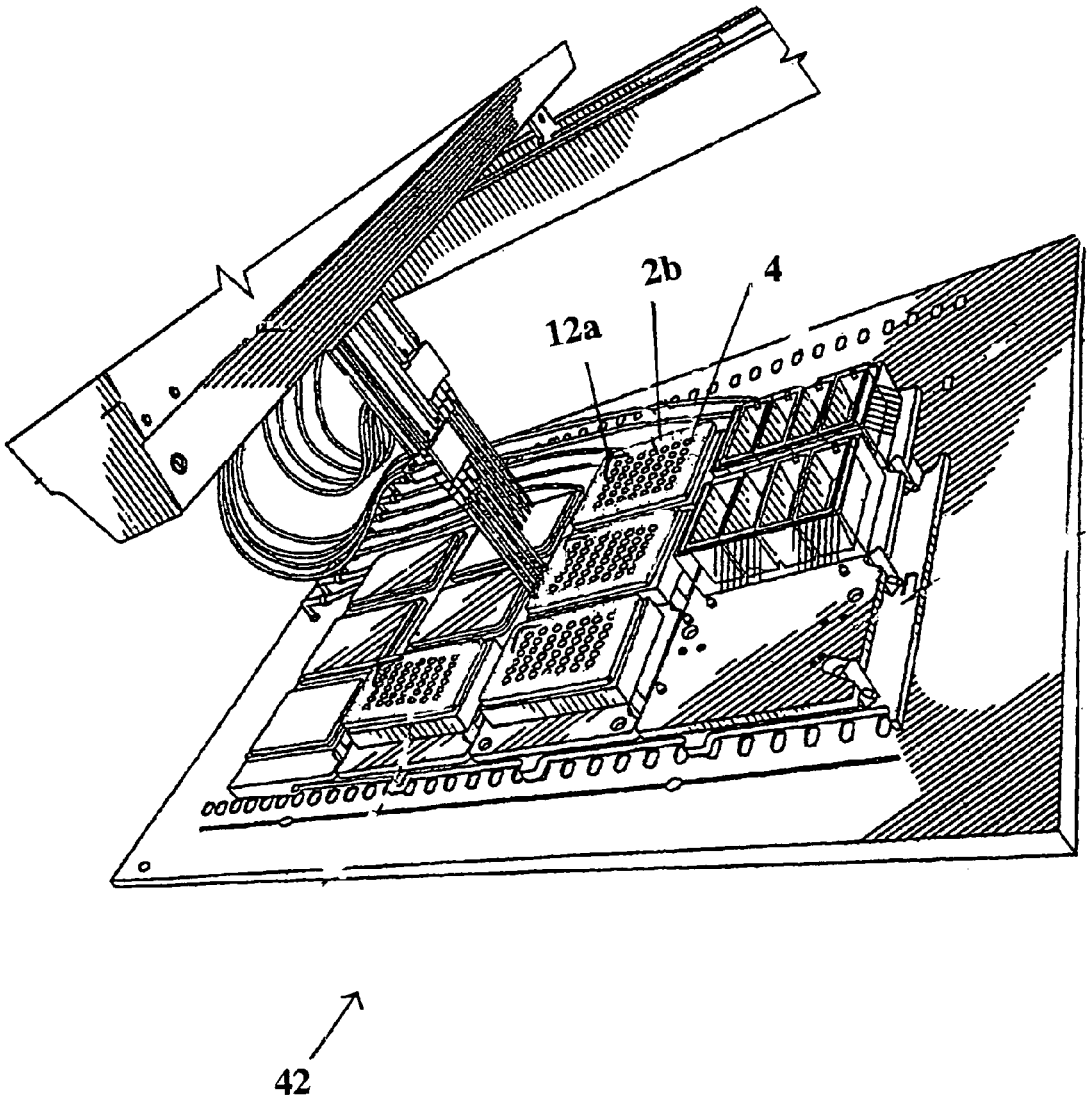
FIG. 9 is a side perspective view of a processing center loaded with multi-well plates labeled according to the invention.

Referring now to FIG. 9, a high-throughput device 40 for performing automated pipetting is shown. Multi-well plates 2*b* are shown properly loaded into the device 40. The plates 2*b* have an L shaped upper label 12*a* placed in the upper right hand corner of the upper side 4*a* thereon. An advantage to the label of the present invention is to be able to visually confirm proper placement of multi-well plates in devices. The operator of the device can quickly obtain a visual confirmation that the device is loaded properly by visualizing the labels. This provides an advantage over conventional labels which are often clear raised alphanumeric indicators which are difficult to see in generally, and particularly when loaded into a device.

There are no particular limitations to the particular indicia used for the labels of the invention so long as the label or labels will be readily visually observable. To this end, the labels are desirably in colors which contrast with the color of the multi-well plate which are clear typically transparent, semi-transparent or opaque white. Suitable indicia may be in any form. For example, shapes, letters, numbers or combinations thereof may be used. Colors such as red, white, yellow, black, blue and green used alone or in combination are suitable.

It is possible to select labels that are removable and use the labeling convention discussed herein to place labels to confirm orientation in one phase of use of the plates, and then to remove the labels during a different phase of use. Thus, if the color of the labels interferes with certain testing protocols, it can be removed at that time. However, more advantageously, the labels will be substantially permanently affixed onto the plates so as to resist removal during normal conditions of handling.

Multi-well plates labeled according to the invention may be constructed of any suitable material, desirably a polymeric material. Selection of the material will be based on its compatibility with the conditions present in the particular operation to be performed with the multi-well plates. Such conditions can include extremes of pH; temperature, and salt concentration. Additional selection criteria include the inertness of the material to critical components of an analysis or synthesis to be performed, such as proteins, nucleic acids, and the like. If conditions of handling the multi-well plates are expected to involve repeated freeze/thaw cycles, then polypropylene or high density polyethylene are preferred. A translucent material such as polystyrene or polypropylene is desirable for use in making multi-well plates, in order to allow a user to confirm proper fill level or to facilitate later spectroscopic or other detection.

The multi-well plates may be fabricated using any suitable means, including conventional molding and casting techniques, extrusion sheet forming, calendaring, thermoforming, and the like. For example, with apparatus prepared from a plastic material, a silica mold master, which is negative for the plate, can be prepared by methods generally known in the art. A liquefied polymer may then be added to the mold to form the part.

The labels for the plates may be placed on the multi-well plates after fabrication. One method for applying substantially permanently affixed labels to the plates is known as pad printing. In pad printing, the indicia is placed at one or more predetermined locations on the multi-well plate using plastic compatible inks. Pad printing is a process in which a silicon-based pad of a pad printing machine (Model 805, Service Tectonics, Adrian, Mich.) picks up the desired ink (18 Series, Service Tectonics, Adrian, Mich.).

Alternatively, the labels may be applied via a hot stamping technique in which colored films are melted onto the plastic. Hot Stamping is a process in which pre-printed foil or film (TPF transfer printing foil, available from Maple Roll Leave, Ontario, Canada) of a Hot Stamping machine (Model HSCS 100, Service Tectonics, Adrian, Mich.) is applied to a surface with a silicone rubber or metal die. Application of heat and pressure transfers the image onto the surface.

It will be apparent that the present invention has been described herein with reference to certain preferred or exemplary embodiments. The preferred or exemplary embodiments described herein may be modified, changed, added to, or deviated from without departing from the intent, spirit and scope of the present invention.

What is claimed is:

1. A multi-well plate, comprising:

a multi-well plate body having a plurality of wells formed therein, said wells being arranged in an array of columns and rows, said columns of wells being arranged in side-by-side fashion with a first of said columns of wells being adjacent to a second of said columns of wells but not interposed between said second column and another of said columns of wells, said rows of wells being arranged in side-by-side fashion with a first of said rows of wells being adjacent to a second of said rows of wells but not interposed between said second row and another of said rows of wells, a first plurality of alphanumeric indicators arranged in a single column, each of said first plurality of alphanumeric indicators being arranged in collinear alignment with a single of said rows of said wells, said first plurality of alphanumeric indicators being in a one-to-one correspondence with said rows of said wells;

a second plurality of alphanumeric indicators arranged in a single row, each of said second plurality of alphanumeric indicators being arranged in collinear alignment with a single of said columns of said wells, said second plurality of alphanumeric indicators being in a one-to-one correspondence with said columns of said wells; and, a visually observable indicia in a predetermined position on at least an upper side of a portion of said multi-well plate body, said indicia having a color in contrast to said multi-well plate body and being substantially permanently affixed to at least said upper side, wherein said indicia is spaced from said alphanumeric indicators, wherein said visually observable indicia is located on one side of said first column opposite said second column and located on one side of said first row opposite said second row such that said visually observable indicia is not collinearly aligned with any of said columns of wells or said rows of wells.

2. The multi-well plate of claim 1, wherein said indicia is a single symbol, said symbol comprising at least one of a shape, a letter and a number.

3. The multi-well plate of claim 2, wherein said multi-well plate is substantially rectangular, said predetermined position being one of an upper right hand corner, an upper left hand corner, a lower right hand corner and a lower left hand corner of said upper side.

4. The multi-well plate of claim 1 wherein said indicia is a substantially permanently affixed ink representation of a dot, a star, a cross or an L shaped symbol.

5. The multi-well plate of claim 1, wherein said color is at least one of black, white, yellow, red, blue and green.

6. The multi-well plate of claim 1, further comprising a second indicia arranged on a side wall of said multi-well plate body, said second indicia being visually observable when a series of said multi-well plates are in a stacked configuration.

7. The multi-well plate of claim 1, wherein said multi-well plate is a multi-well filter plate.

8. The multi-well plate of claim 1, wherein said indicia comprises a plastic compatible ink.

9. The multi-well plate of claim 1, wherein said indicia comprises a film/foil melted on said multi-well plate body.

10. The multi-well plate of claim 1, wherein said indicia is affixed using pad printing.

11. The multi-well plate of claim 1, wherein said indicia is affixed using hot stamping.

12. A method for labeling multi-well plates, comprising the steps of:

selecting a predetermined position for placement of said indicia in preparing a multi-well plate of claim 1 as a convention; and consistently using said convention to visibly confirm proper placement of multi-well plates in a device or laboratory setting.

13. The method of claim 12, wherein said multi-well plate is substantially rectilinear, said predetermined position being one of an upper right hand corner, an upper left hand corner, a lower right hand corner and a lower left hand corner of said upper side.

14. The method of claim 12, wherein said color is at least one of black, white, yellow, red, blue and green.

15. The method of claim 12, further comprising the step of selecting a second predetermined position for placement of a second indicia, wherein said second predetermined position is selected so as to allow said second indicia to be visually observable when a series of said multi-well plates are placed in a stacked configuration.

16. The multi-well plate of claim 1, wherein said multi-well plate is a frame for accommodating one or more multi-well strips.

17. An assembly comprising:

a multi-well plate formed in accordance with claim 1; and a tray formed to accommodate said multi-well plate, wherein a second indicia is arranged on said tray.

18. The assembly of claim 17, further comprising a lid.

19. The assembly of claim 18, wherein a third indicia is arranged on said lid.

* * * * *